US009222481B2

(12) United States Patent
Alban

(10) Patent No.: US 9,222,481 B2
(45) Date of Patent: Dec. 29, 2015

(54) MOTOR COMPRESSOR UNIT HAVING A TORSIONALLY FLEXIBLE COUPLING

(75) Inventor: Thomas Alban, Chatenoy le Royal (FR)

(73) Assignee: Thermodyn, Le Creusot (FR)

( * ) Notice: Subject to any disclaimer, the term of this patent is extended or adjusted under 35 U.S.C. 154(b) by 133 days.

(21) Appl. No.: 13/331,456

(22) Filed: Dec. 20, 2011

(65) Prior Publication Data

US 2012/0164005 A1 Jun. 28, 2012

(30) Foreign Application Priority Data

Dec. 22, 2010 (FR) ..... 10 61068

(51) Int. Cl.
*F04D 29/054* (2006.01)
*F04D 29/04* (2006.01)
*F04D 29/044* (2006.01)

(52) U.S. Cl.
CPC ..... *F04D 29/054* (2013.01); *F04D 29/044* (2013.01); *F04D 29/0405* (2013.01)

(58) Field of Classification Search
CPC . F04D 29/0405; F04D 29/043; F04D 29/044; F04D 29/05; F04D 29/053; F04D 29/054
USPC ..... 417/360, 357, 349, 365, 423.15
See application file for complete search history.

(56) References Cited

U.S. PATENT DOCUMENTS

| | | | | |
|---|---|---|---|---|
| 2,434,979 | A * | 1/1948 | Bergh | 417/359 |
| 2,766,695 | A * | 10/1956 | Gailloud | 417/357 |
| 2,958,292 | A * | 11/1960 | Lipe et al. | 417/357 |
| 3,031,973 | A * | 5/1962 | Kramer | 417/357 |
| 3,195,466 | A * | 7/1965 | Young | 417/357 |
| 3,267,868 | A * | 8/1966 | Page | 417/370 |
| 3,294,027 | A | 12/1966 | Denis | |
| 3,873,242 | A * | 3/1975 | Anderson | 417/360 |
| 3,918,852 | A * | 11/1975 | Carter | 417/423.12 |
| RE34,276 | E * | 6/1993 | Glaser et al. | 417/407 |
| 7,344,362 | B2 | 3/2008 | Kopp et al. | |
| 2004/0179961 | A1 * | 9/2004 | Pugnet et al. | 417/423.5 |
| 2006/0024174 | A1 * | 2/2006 | Welch | 417/360 |
| 2007/0196215 | A1 * | 8/2007 | Frosini et al. | 417/120 |
| 2009/0220362 | A1 * | 9/2009 | Gausmann et al. | 417/423.12 |

FOREIGN PATENT DOCUMENTS

| | | | |
|---|---|---|---|
| CN | 1650092 | A | 8/2005 |
| EP | 1273757 | A1 | 1/2003 |
| GB | 2469217 | A | 10/2010 |
| WO | 2004083644 | A1 | 9/2004 |

OTHER PUBLICATIONS

EPO Form 1503, Jan. 8, 2011, French Search Report for FR 1061068.
Unofficial English Translation of Chinese Office Action issued in connection with corresponding CN Application No. 201110463229.5 on Apr. 29, 2015.

* cited by examiner

*Primary Examiner* — Bryan Lettman
*Assistant Examiner* — Timothy P Solak
(74) *Attorney, Agent, or Firm* — Mintz Levin Cohn Ferris Glovsky and Popeo, P.C.; Steven M. Jensen

(57) ABSTRACT

A motor compressor unit (1) comprises a motor (3) and a compressor (2) which are mounted in a common housing (4) sealed against the gas to be compressed. The motor (3) comprises a rotor (39) rotatably connected to a rotor (38) of the compressor (2). The rotor (38) of the compressor comprises a main shaft (11) and a connecting shaft (21) coaxial with the main shaft, the connecting shaft being placed at least partly inside the main shaft (11) so as to be radially spaced from the main shaft (11) and comprising a coupling zone (15) for coupling with the main shaft (11).

15 Claims, 3 Drawing Sheets

MOTOR COMPRESSOR UNIT HAVING A TORSIONALLY FLEXIBLE COUPLING

RELATED APPLICATION

Figure 1:
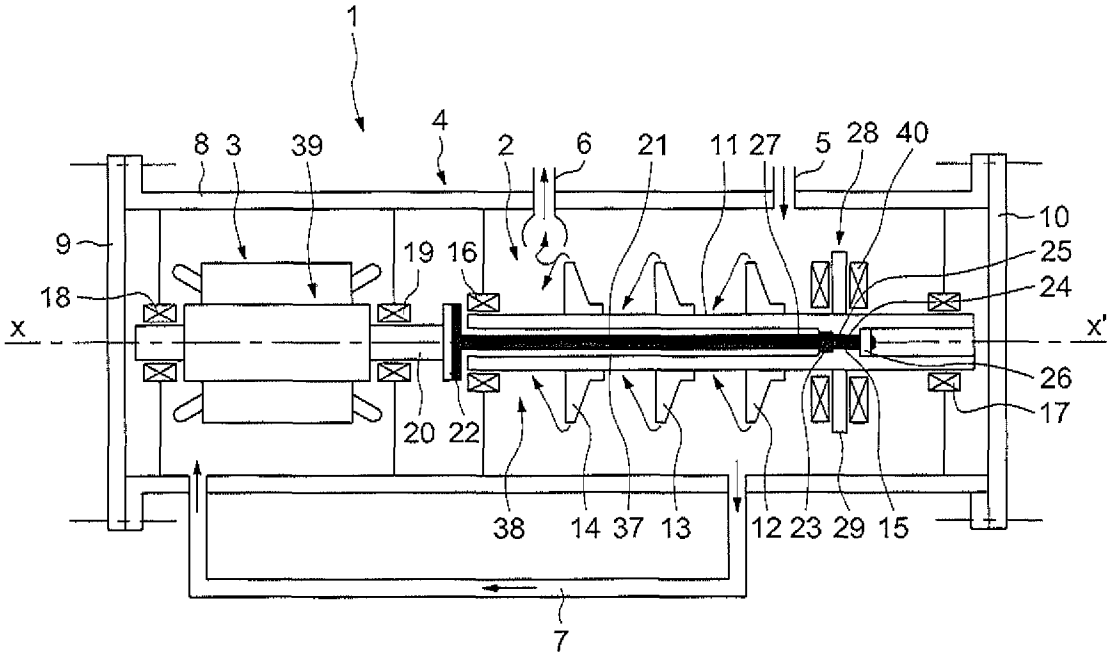

This application claims priority to French application Ser. No. FR 10 61068, filed Dec. 22, 2010, the entire disclosure of which is incorporated herein by this reference.

The invention relates to turbocompressors or motor compressors and in particular to integrated motor compressor units. An integrated Motor compressor unit comprises a sealed housing in which are placed an electric motor and a compressor unit, for example with several stages, which comprises several compression impellers supported by a driven shaft driven by the rotor of the motor.

It has initially been proposed to couple the driven shaft and the rotor by means of a rigid coupling, bearings being provided to support the ends of the shaft line of the motor compressor unit and its middle portion.

However, such a structure requires, on assembly, a perfect alignment of the rotor and the driven shaft. It has therefore been proposed to couple the rotor and the driven shaft by means of a flexible coupling, in order to dispense with the alignment problems. Moreover, this solution allows the rotor and the driven shaft to keep their own vibration modes, because they remain mechanically uncoupled. In this regard it is possible to refer to document WO 2004/083644 which describes such an arrangement. In order to take the compressor out of the housing for maintenance operations, it is necessary to gain access to the flexible coupling members through radial openings in the housing. These radial openings, even though they are furnished with sealed access hatches, may be sources of leaks of the gas contained in the housing.

When the gas to be compressed is combustible, these leaks may generate, by mixing with the ambient air, an explosive atmosphere. The sealing requirements of such turbocompressors are therefore the subject of very strict regulation restricting the design of such motor compressors.

Moreover, the flexible couplings used, which are usually of the membrane type, increase the axial bulk of the motor compressor unit (typically of the order of 35 to 40 cm relative to a rigid coupling with flanges), and represent an area of weakness because they can only withstand limited tension or compression stresses in the axial direction.

In order to allow considerable axial forces on the shafts, the use of such flexible couplings therefore implies at least one axial abutment on the rotor of the motor, and another axial abutment secured to the driven shaft.

The object of the invention is to propose an integrated turbocompressor unit that is compact in the axial direction, of which the axial rigidity makes it possible to use only one axial abutment without limitation of the axial forces applied, the architecture of the motor compressor unit generating a reduced risk of gas leaks and allowing easy dismantling for the purpose of maintenance operations.

For this purpose, the motor compressor unit comprises a motor and a compressor which are mounted in a common housing sealed against the gas to be compressed. The motor comprises a rotor rotatably connected to a rotor of the compressor. The rotor of the compressor comprises a main shaft and a connecting shaft coaxial with the main shaft, the connecting shaft being placed at least partly inside the main shaft so as to be radially spaced from the main shaft and comprising a coupling zone for coupling with the main shaft.

In one embodiment, the motor compressor unit is a centrifugal motor compressor unit. The centrifugal compression stages are supported by the main shaft.

According to another feature of the invention, the motor compressor unit comprises at least two bearings supporting the main shaft, the connecting shaft extending beyond one of the bearings, that is to say passing through the bearing.

Advantageously, the connecting shaft extends beyond a bearing supporting the main shaft and also beyond one or more compression stages, that is to say beyond one or more rows of blades of the compressor. According to a preferred embodiment, the connecting shaft extends beyond all of the compression stages of the main shaft.

The motor compressor unit preferably comprises at least two bearings supporting a shaft of the rotor of the motor, two bearings supporting the main shaft of the compressor, and comprises a single axial abutment, placed either on the shaft of the motor rotor or on the main shaft.

The flywheel of the axial abutment may be placed axially between the coupling zone (including around the coupling zone), and the blades of the main shaft.

According to another embodiment, the compressor has no axial abutment, an axial abutment being connected to the rotor of the motor.

Preferably, the motor compressor unit comprises dismountable attachment means capable of securing in the coupling zone, both axially and rotatably, the connecting shaft to the main shaft of the compressor.

Advantageously, the dismountable attachment means are configured so as to be able to be disengaged by handling them from an access at one axial end of the housing.

According to a preferred embodiment, an axial abutment flywheel is assembled about a portion of the main shaft surrounding an element of the dismountable attachment means.

According to an advantageous embodiment, the motor compressor unit comprises an axial abutment comprising a flywheel that is in one piece with a portion of the main shaft.

According to a preferred embodiment, the motor compressor unit comprises a low-pressure gas inlet and a high-pressure gas outlet axially closer to the motor than the low-pressure inlet, and the radial space separating the main shaft and the connecting shaft is of a width capable of allowing a spontaneous flow of the gases exiting the motor towards the low-pressure inlet zone.

Advantageously, the main shaft comprises one or more radial orifices connecting the outside of the main shaft and the radial space.

Advantageously, the main shaft comprises at least one first radial orifice or one first group of radial orifices connecting the radial space and the outside of the main shaft, this or these orifices emerging to the outside of the main shaftupstream of a row of blades.

According to a preferred embodiment, the first radial orifice or the first group of radial orifices emerges between the coupling zone and the first compression stage, which is the row of blades at a greatest distance from the motor.

In this preferred embodiment, the first radial orifice or the first group of radial orifices may in particular emerge between the abutment and the first compression stage.

Advantageously, the main shaft also comprises at least one second radial orifice or one second group of radial orifices emerging between an axial balancing piston and a radial bearing, which is the radial bearing closest to the motor and supporting the main shaft.

According to a preferred embodiment, the housing of the motor compressor unit has no radial openings which are designed specifically to provide the connection between the various shafts.

In particular, the housing of the motor compressor unit may have, as sole radial openings, only openings for the inlet and outlet of the gases to be compressed, that is to say an uncompressed gas inlet and a compressed gas outlet, and possible gas branch connections used for recirculation of a secondary flow, of gas making it possible, for instance, to optimize the cooling of the motor.

The Motor compressor unit may comprise a damping device placed between the connecting shaft and the main shaft.

According to a first embodiment, the connecting shaft is rigidly connected to the main shaft in the coupling zone. According to a second embodiment, a damping device is arranged between the connecting shaft and the main shaft.

Figure 2:
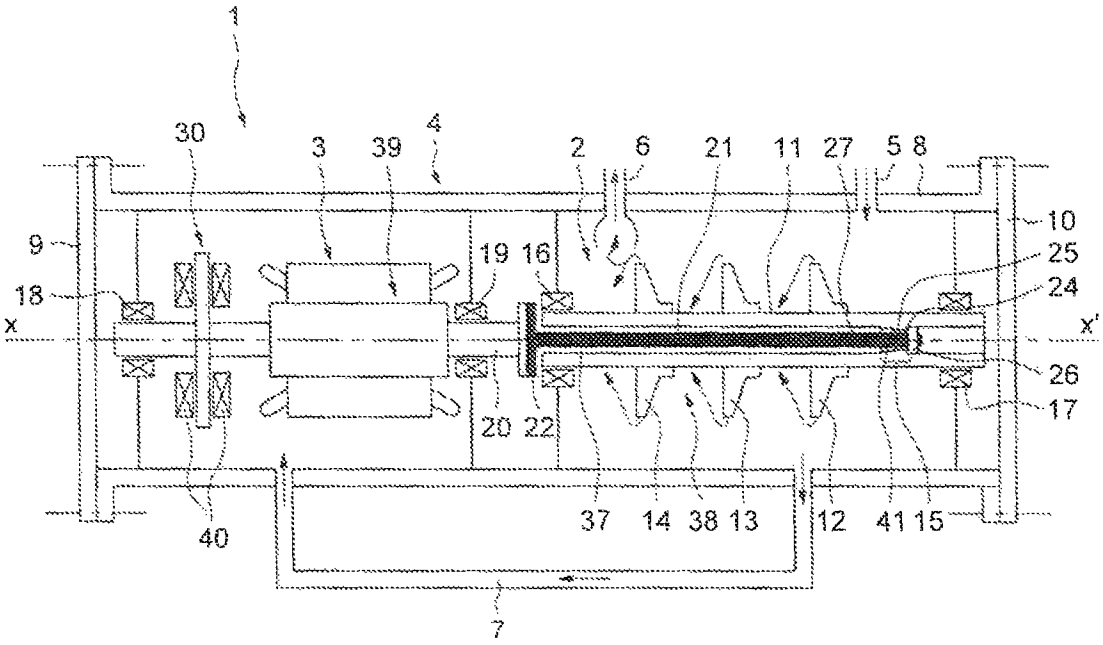
Figure 3:
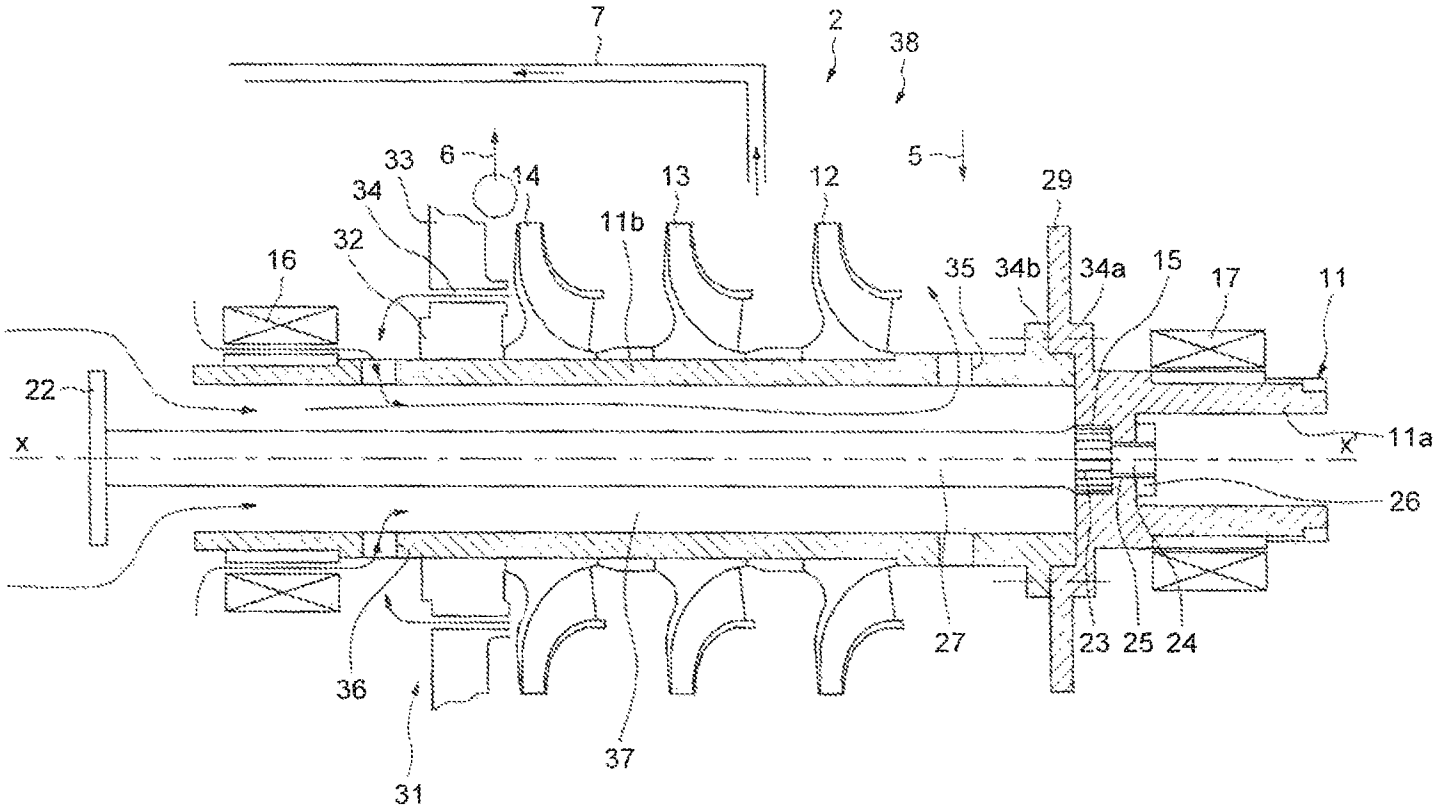

Other objects, features and advantages of the invention will appear on reading the following description given only as a non-limiting example and made with reference to the appended drawings in which:

FIG. 1 illustrates a general diagram of a motor compressor unit according to the invention, FIG. 2 represents another embodiment of a motor compressor unit according to the invention, FIG. 3 represents a detail view of a third embodiment of a motor compressor unit according to the invention.

As illustrated in FIG. 1, the motor compressor unit indicated by the general reference 1 comprises a compressor 2 rotated by an electric motor 3. The common rotation axis of the motor 3 and of the compressor 2 is indicated as the axis x-x'. The compressor 2 and the motor 3 are placed inside a common housing 4. The housing may for example take the form of a generally cylindrical body 8, closed in a sealed manner at its ends by two covers 9, 10 situated respectively at the end near the motor and at the end near the compressor, and retained for example by being bolted onto the body 8.

The motor and the compressor are therefore placed in the gas processed by the motor compressor unit.

In order to simplify the representation, only the rotor portion of the compressor 2 is shown in the figures. The rotor 38 of the compressor 2 notably comprises a main shaft 11, one or more rows of impellers (or compression wheels) 12, 13, 14 mounted on the main shaft 11, and a connecting shaft 21 partly placed inside the main shaft, and connected both to the rotor 39 of the motor and to the main shaft 11.

The rows of impellers 12, 13, 14 are mounted on the main shaft 11 of the compressor 2 at increasing distances from one end of the main shaft 11 of the compressor 2, which is in this instance the end opposite to the motor 3. Of course, the compressor 2 may comprise any number of rows of blades which may moreover point towards the motor. Between two rows of impellers of the main shaft 11 of the compressor 2 a row of stator blades of the compressor 2 is inserted, not shown in the figure in order to declutter the representation. The stator blades are secured to a cartridge (not shown) surrounding the main shaft 11, and pointing radially towards the main shaft 11.

The main shaft 11 is supported radially by two bearings 16 and 17 situated respectively on the side of the motor 3 and on the side opposite to the motor 3. The rotor 39 of the motor 3 is carried by a motor shaft 20 which is supported radially by two bearings 18 and 19. The bearings 16, 17, 18, 19 are preferably bearings that do not require a supply of lubricating liquid. It is possible, for this purpose, for example, to use bearings of the active magnetic type, or gas bearings.

The cartridge and the bearings 16, 17 of the compressor, which are secured to the housing 4 during the operation of the compressor, may be unlocked from the housing during maintenance operations in order to take out axially, through the end of the housing corresponding to the cover 10, the whole assembly of stator cartridge, bearings 16, 17 and rotor (carried by the shaft 11), from the compressor 2.

The gas which the compressor 2 must compress is fed in through a gas intake orifice 5 upstream of the first row of blades 12. After having passed the successive rows of blades 12, 13, 14, it comes out of the compressor through a gas outlet orifice 6. In order to cool the motor 3, a cooling duct 7 taps some partially compressed gas downstream of the first row of blades 12, and carries this gas towards the motor 3 in order to cool the latter. The tapping may be carried out downstream of another row of blades or otherwise downstream of the outlet orifice 6 if the temperature allows it.

The main shaft 11 is hollowed out in its central portion, that is to say in the vicinity of its axis, between an open end facing the motor 3, and a coupling zone 15 of the main shaft 11 in which it is secured to the connecting shaft 21. In the embodiment of FIG. 1, the main shaft 11 is also hollowed out in its centre on an axial portion situated between its end opposite to the motor 3 and the coupling zone 15.

The coupling zone 15 is between the bearings 16 and 17 supporting the main shaft 11, and more precisely between the set of blades carried by the main shaft 11 and the bearing 17 placed on the side opposite to the motor 3 relative to this set of blades.

The hollowing that passes through the main shaft 11 on either side of the coupling zone 15 is an axi-symmetric cylindrical hollowing centred on the rotation axis x-x' of the motor 3 and of the compressor 2.

As can be seen, the connecting shaft 21 extends at least partly inside the main shaft 11. In particular, the connecting shaft 21 has a section smaller than that of the central hollowing of the main shaft 11, and extends up to the coupling zone 15 of the main shaft 11. A radial space 37 is thus arranged between the main shaft 11 and the connecting shaft 21.

Moreover, the connecting shaft 21 provides the coupling between the main shaft 11 and the shaft 20 of the rotor of the motor. The motor shaft 20 is assembled rigidly, for example by flanges 22, to the connecting shaft 21. The connecting shaft 21 is secured, via its end opposite to the motor 3, to the coupling zone 15. The connecting shaft 21 is preferably made of a material with a high yield strength. It is thus capable of withstanding the torsional stress of the motor on a reduced section, and, by virtue of this reduced section, can be assembled inside the main shaft 11 by arranging the radial space 37. According to the variant embodiments, it is possible to use a connecting shaft of which the external diameter is less than half of the external diameter of the motor shaft 20.

This reduced section also makes it possible, between the two ends of the connecting shaft 21, to remain within an elastic range of flexional deformation despite permanent angular or lateral misalignments between the main shaft and the motor shaft. This flexibility also makes it possible to filter the flexional vibrations between the main shaft and the motor shaft. Moreover, the reduced section of the connecting shaft allows a gradation of the forces transmitted during sudden changes of the torque transmitted by the motor, or of the resistive torque exerted by the compressor.

The connecting shaft 21 has a central portion 27 of substantially constant section between the assembly flange 22 and the end secured to the coupling zone 15 of the main shaft 11. At the end secured to the coupling zone 15, dismountable attachment means provide the coupling between this connecting shaft 21 and the main shaft 11.

In a particular embodiment illustrated here, the connecting shaft 21 has a splined zone 23. The splines arranged on its outer circumference match the hollow splines arranged on the coupling zone 15 of the main shaft 11.

Beyond its splined portion 23, the connecting shaft 21 continues with a threaded portion 24 with a section smaller than that of the splined portion 23. This threaded portion passes through an orifice 25 of corresponding diameter, arranged in the coupling zone 15. A nut 26 is screwed onto the threaded portion 24 on the side of the coupling zone 15 which is opposite to the body 27 of the connecting shaft 21.

The connecting shaft 21 is thus, in the coupling zone 15, secured to the main shaft 11 both in rotation and in axial movement.

During maintenance operations, in order to take the compressor 2 out of the housing 4, one only has to remove the end cover 10, to unscrew the nut 26, to separate the stator cartridge and the bearings 16, 17 from the housing and to axially extract the compressor 2 through the opening of the cover 10. No radial orifice in the housing is necessary for separating the motor 3 and the compressor 2. The gas intake orifices 5, gas outlet orifices 6, and the orifices corresponding to the cooling duct 7 are the only radial orifices arranged in the housing 4 of the motor compressor unit. This limits the risk of leakage and of generation of explosive atmospheres in the vicinity of the compressor. Limited radial openings may however be arranged in order to separate the motor shaft 20 and the connecting shaft 37 at the flange 22.

The connection obtained by means of the connecting shaft 21 between the motor shaft 20 and the main shaft 11 is rigid in the axial direction.

A single axial abutment 28, which interacts with axial bearings 40, provides the axial retention of the line of shafts. The axial abutment 28 is also preferably of the type that does not require a supply of lubricating liquid, for example is an abutment of the active magnetic type.

In the embodiment of FIG. 1, the abutment 28 comprises an abutment flywheel 29 shrink-fitted around the coupling zone 15 and attached to the main shaft 11. Although the threaded portion 24 of the connecting shaft 21 passes through the coupling zone 15, the coupling zone 15 is in this instance the radially most rigid zone of the main shaft 11, since this shaft is hollowed out over a larger section than the orifice 25 on either side of the coupling zone 15.

FIG. 2 illustrates a second embodiment of the invention. FIG. 2 shows elements that are common to FIG. 1, the same elements then being indicated by the same references. The arrangements of the motor 3, the compressor 2, the low-pressure inlet 5 for the gases to be compressed and the outlet 6 for the compressed gases are similar to those of FIG. 1.

In the embodiment of FIG. 2, a single axial abutment 30 is also provided for the axial retention of the motor 3 and of the compressor 2, this axial abutment 30 this time being placed between the bearings 18 and 19 supporting the rotor of the motor 3. In the embodiment of FIG. 2, the compressor 2 therefore has no abutment. Another solution that is not shown but is advantageous may consist in placing the abutment at the end of the motor rotor 39 after the bearing 18. As shown in FIG. 2, the connecting shaft 21 is arranged at least partially inside the main shaft 11 so as to be radially spaced apart from the main shaft 11, and includes the coupling zone 15 for coupling with the main shaft 11. In the coupling zone 15, a damping device 41 is placed between the connecting shaft 21 and the main shaft 11, so as to transmit torque while dampening torque vibrations.

FIG. 3 is a simplified partial section of a compressor belonging to a motor compressor unit according to a third embodiment of the invention. FIG. 3 shows references that are common to FIGS. 1 and 2, the same elements then being indicated by the same references. Notably FIG. 3 shows the connecting shaft 21, the body of the connecting shaft 27, the splined portion 23 of the connecting shaft, its threaded portion 24 and the retaining nut 26.

Also found in FIG. 3 is an axial balancing piston 31 comprising a rotary portion 32 and facing a piston fixed portion 33 secured to the stator cartridge (not shown). The rotary portion 32 and the fixed portion 33 are separated by a narrow gap 34 serving as a labyrinth seal, through which a leakage current of the high-pressure gas contained upstream of the piston flows (upstream is to be understood as upstream relative to the direction of flow of the gases in the compressor 2).

In the embodiment of FIG. 3, the gas-inlet orifice 5 is further from the motor 3 than the compressed-gases outlet orifice 6, which is itself a little further from the motor 3 than the piston 31. The radial space 37 separating the main shaft 11 from the connecting shaft 21 extends from the open end on the motor side of the shaft 11, beyond the bearing 16, of the piston 31 and of the set of blades of the main shaft 11.

The main shaft 11 is in this instance made in several sections, namely a first axial section 11*a* comprising the coupling zone 15, and a second section 11*b*. The main shaft 11 is hollowed out in its radially central portion as already described, where the hollowing is located in the second section 11*b*. The two sections are connected by a flange system 34*a* and 34*b*, the flange 34*a* being in one piece with a flywheel 29 forming a portion of the axial abutment of the motor compressor unit.

Producing the main shaft 11 in several portions makes it possible to choose the manufacturing techniques best suited to each of the constituent elements. Moreover, this decoupling makes it possible to fabricate the abutment flywheel 29 in a one-piece manner with the section 11*a*, which would be markedly more complicated if the connecting shaft 21 were made in a single piece.

It is also possible to envisage variant embodiments in which the abutment flywheel 29 is made in the form of a separate disc flanged between the two sections 11*a* and 11*b*.

FIG. 3 shows radial orifices arranged in the section 11*b* of the main shaft. A first orifice or group of orifices 35 is arranged in the low-pressure zone situated upstream (relative to the flow of the gases in the compressor 2) of the row of blades 12, in the axial vicinity of the gas-inlet orifice 5.

A second orifice or group of orifices 36 is arranged in the main shaft 11, between the piston 31 and the magnetic bearing 16. This or these orifices 36 associated with the radial space 37 make it possible to channel to the inside of the main shaft 11 on the one hand the gases that have leaked through the labyrinth 34, and on the other hand a gas flow that has passed through the magnetic bearing 16 from the end of the main shaft 11 situated on the side of the motor 3. The dimensions of the orifices 35, 36 and the radial width of the space 37 are chosen so as to allow a spontaneous flow of the gases originating from the motor or of the gases collected by the orifice 36.

The orifice or orifices 35 arranged in the low-pressure zone make it possible to bring into this low-pressure zone, from the open end of the main shaft 11, on the one hand the hot gases originating from the gas flow that has been used to cool the motor 3, and on the other hand the gases collected by the orifice 36 returning from the gases of the piston 31. The gases heated by the motor 3 are then mixed with the gases entering the turbocompressor through the orifice 5, thus "diluting" the calories evacuated from the motor 3 in the flow of gas to be compressed.

The main shaft 11 in this way becomes an integral part of the cooling circuitry of the motor compressor unit.

The object of the invention is not limited to the examples described and may have numerous variants. It is possible, for example, to envisage placing the axial abutment between the bearings 16 and 19, either on the motor shaft 20 or on the connecting shaft 21, or otherwise between the flanges 22 connecting the two shafts. It is also possible to envisage placing the axial abutment both on the outside of the bearings of the motor and on the outside of the bearings of the compressor, that is to say to the left of the bearing 18 or to the right of the bearing 17 in FIG. 1. It is possible to envisage using several axial abutments. The bearing 16 from which the gas flow is captured by channelling it with the aid of the orifice 36 may be a magnetic bearing or a gas bearing.

It is possible to envisage placing the coupling zone 15 at the end of the main shaft 11 and/or positioning it beyond the end bearing 17 for supporting the main shaft 11. It is also possible to conceive of a main shaft 11 in which the coupling zone is closer to the motor than a portion of the blades. It is possible to envisage inserting the connecting shaft 21 not into a hollow shaft 11 of the compressor but into a hollow shaft 20 of the rotor of the motor 3.

Although the invention is preferably applied to centrifugal compressors, it could equally be applied to axial compressors.

The motor compressor unit according to the invention makes it possible to have a flexible coupling between motor and compressor of which the rigidity and the axial compactness are improved. The motor compressor unit according to the invention also makes it possible to simplify the architecture of the motor compressor unit notably in the cooling pipework and circuits. The overall sealing of the compressor is improved as is its ease of maintenance.

LIST OF REFERENCES

1 Motor compressor unit
2 Compressor
3 Motor
4 Housing
5 Gas intake orifice
6 Gas outlet orifice
7 Cooling duct
8 Cylindrical body
9 End cover
10 End cover
11 Main shaft
12, 13, 14 Rows of blades
15 Coupling zone
16, 17 Bearings of the compressor
18, 19 Bearings of the rotor of the motor
20 Motor shaft
21 Connecting shaft
22 Flange
23 Splined portion
24 Threaded portion
25 Orifice
26 Nut
27 Body of the connecting shaft
28 Axial abutment
29 Axial abutment flywheel
30 Axial abutment
31 Axial balancing piston
32 Piston rotary portion
33 Piston fixed portion
34*a* Flange
34*b* Flange
35 Return orifice for the motor cooling gases
36 Return orifice for the piston leaks
37 Radial space between the main shaft 11 and the connecting shaft 21
38 Rotor of the compressor
39 Rotor of the motor
40 Axial abutment bearings
x-x' Common rotation axis of the motor and of the compressor

The invention claimed is:

1. A motor compressor unit, comprising:

a motor for driving a compressor, wherein the motor and the compressor are mounted in a common housing, the housing being sealed against gas to be compressed, the compressor comprising a first rotor having a main shaft with at least one hollow portion with an open end free of contact facing the motor;

a connecting shaft coaxial with the main shaft, extending axially between the motor and the compressor, placed at least partially within the hollow portion of the main shaft, and rotatably connecting a second rotor of the motor to the first rotor; and a single coupling zone at one end of the connecting shaft, arranged between the main shaft and the connecting shaft, the coupling zone enabling the connecting shaft to rotate and drive the main shaft, wherein a free portion of the connecting shaft extends between the coupling zone and the motor, and traverses the hollow portion of the main shaft so as to leave a radial space between the main shaft and the connecting shaft along the hollow portion and an axial space between said open end and a motor end of the connecting shaft.

2. The motor compressor unit according to claim 1, further comprising at least two bearings supporting the main shaft, the connecting shaft extending beyond one of the bearings.

3. The motor compressor unit according to claim 2, further comprising a low-pressure gas inlet and a high-pressure gas outlet axially closer to the motor than a low-pressure inlet, in which the radial space separating the main shaft and the connecting shaft is of a width that allows a spontaneous flow of gases exiting the motor towards the low-pressure inlet.

4. The motor compressor unit according to claim 3, wherein the main shaft comprises one or more radial orifices connecting an outside of the main shaft and the radial space.

5. The motor compressor unit according to claim 4, wherein the main shaft comprises at least one radial orifice connecting the radial space and the outside of the main shaft, and emerging upstream of a row of blades of the compressor.

6. The motor compressor unit according to claim 5, wherein the main shaft comprises at least one second radial orifice emerging between a piston labyrinth seal and a radial bearing, which is the radial bearing closest to the motor and supporting the main shaft.

7. The motor compressor unit according to claim 4, wherein the main shaft comprises at least one second radial orifice emerging between a piston labyrinth seal and a radial bearing, which is the radial bearing closest to the motor and supporting the main shaft.

8. The motor compressor unit according to claim 1, further comprising two bearings supporting the second rotor of the motor, at least two additional bearings supporting the main shaft of the compressor, and a single axial abutment placed either on the shaft of the second rotor of the motor, or on the main shaft.

9. The motor compressor unit according to claim 8, further comprising an axial abutment comprising a flywheel that is in one piece with a portion of the main shaft.

10. The motor compressor unit according to claim 1, comprising dismountable attachment means configured to secure both axially and rotationally the connecting shaft to the main shaft of the compressor in the coupling zone.

11. The motor compressor unit according to claim 10, wherein the dismountable attachment means is configured so as to be able to be disengaged by handling it from an access at one axial end of the housing.

12. The motor compressor unit according to claim 11, further comprising an axial abutment flywheel assembled about a portion of the main shaft surrounding an element of the dismountable attachment means.

13. The motor compressor unit according to claim 10, further comprising an axial abutment flywheel assembled about a portion of the main shaft surrounding an element of the dismountable attachment means.

14. The motor compressor unit according to claim 1, wherein the motor compressor unit has no radial openings in the housing which are designated specifically to provide connection between the main shaft and the connecting shaft.

15. The motor compressor unit according to claim 1, further comprising a damping device placed between the connecting shaft and the main shaft.

* * * * *